US008283590B2

(12) United States Patent
Sasaki et al.

(10) Patent No.: US 8,283,590 B2
(45) Date of Patent: Oct. 9, 2012

(54) VACUUM CIRCUIT BREAKER

(75) Inventors: Ryosuke Sasaki, Mitaka (JP); Hiromichi Somei, Fuchu (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 472 days.

(21) Appl. No.: 12/539,921

(22) Filed: Aug. 12, 2009

(65) Prior Publication Data

US 2010/0059480 A1 Mar. 11, 2010

(30) Foreign Application Priority Data

Sep. 5, 2008 (JP) ..... 2008-228942

(51) Int. Cl.
*H01H 33/66* (2006.01)

(52) U.S. Cl. ..... 218/140; 218/14

(58) Field of Classification Search ..... 218/140, 218/120, 118, 7, 14; 361/673–678, 688–697
See application file for complete search history.

(56) References Cited

U.S. PATENT DOCUMENTS 5,753,875 A * 5/1998 Benke et al. ..... 218/118
2007/0264856 A1 11/2007 Erk et al.

FOREIGN PATENT DOCUMENTS

| | | | |
|---|---|---|---|
| CN | 101036208 | A | 9/2007 |
| DE | 195 05 370 | A1 | 8/1996 |
| JP | 4-109524 | | 4/1992 |
| JP | 8-222090 | | 8/1996 |
| JP | 2006-140038 | | 6/2006 |
| JP | 2007-273383 | | 10/2007 |
| KR | 20-0212859 | | 6/2001 |
| KR | 200212859 | * | 6/2012 |
| SU | 1601653 | A1 | 10/1990 |
| WO | WO 2006/032626 | A1 | 3/2006 |

OTHER PUBLICATIONS

Office Action issued Feb. 23, 2011 in Korea Application No. 10-2009-0079049 (With English Translation).

Extended Search Report issued Dec. 19, 2011 in European Patent Application No. 09010601.4-2214/2161729.

Office Action issued Aug. 10, 2012, in Chinese Patent Application No. 200910168312.2, (with English-language Translation).

* cited by examiner

*Primary Examiner* — Amy Cohen Johnson
*Assistant Examiner* — Marina Fishman
(74) *Attorney, Agent, or Firm* — Oblon, Spivak, McClelland, Maier & Neustadt, L.L.P.

(57) ABSTRACT

There is provided a vacuum circuit breaker including a vacuum valve, a first main circuit conductor fixed to a fixed current-carrying rod end of the vacuum valve, a polygonal movable conductor connected to a movable current-carrying rod end of the vacuum valve, an operation movable rod connected to the movable conductor in an axial direction and connected to an operation mechanism, a second main circuit conductor, through which the operation movable rod is movably inserted, and at least one extendable flexible conductor, which connects side surfaces of the movable conductor and the second main circuit conductor.

1 Claim, 2 Drawing Sheets

VACUUM CIRCUIT BREAKER

CROSS-REFERENCE TO RELATED APPLICATIONS

This application is based upon and claims the benefit of priority from prior Japanese Patent Application No. 2008-228942, filed Sep. 5, 2008, the entire contents of which are incorporated herein by reference.

BACKGROUND OF THE INVENTION

1. Field of the Invention

The present invention relates to a vacuum circuit breaker, which can enhance a current capacity.

2. Description of the Related Art

In a conventional vacuum circuit breaker, an upper main circuit conductor and a lower main circuit conductor are provided above and under a vacuum valve. The lower main circuit conductor is connected to a movable current-carrying rod of the vacuum valve via an extendable flexible conductor. Since the movable current-carrying rod of the vacuum valve is generally rod-shaped, a plate-like coupling conductor is connected to the movable current-carrying rod and one end of the flexible conductor is connected to the coupling conductor, while the other end thereof is connected to the lower main circuit conductor. A fixed current-carrying rod of the vacuum valve is fixed to the upper main circuit conductor by bolts (see, for example, Jpn. Pat. Appln. KOKAI Publication No. 2007-273383 (pages 3 and 4 and FIG. 1).

The conventional vacuum circuit breaker described above has the following problems.

As the current flowing therethrough increases, the electrical resistance in the main circuit components, such as the main circuit conductor, need be reduced. However, to reduce the electrical resistance, the sectional area of the main circuit components must be large, which causes an increase in size of the outer shape of the vacuum circuit breaker. Further, since the mass of the movable side inevitably increases, the operation energy to operate the movable side and the rigidity of the vacuum circuit breaker body need be increased.

The portion of the main circuit components that most increases the electrical resistance is the movable side, which includes a number of connecting parts. Therefore, it is required to reduce the number of parts of the movable main circuit components and suppress the electrical resistance.

BRIEF SUMMARY OF THE INVENTION

It is an object of the present invention to provide a vacuum circuit breaker, in which the configuration of main circuit components in a movable side is simple to reduce the electrical resistance, thereby to enhance the current capacity.

According to an aspect of the present invention, there is provided a vacuum circuit breaker comprising: a vacuum valve, a first main circuit conductor fixed to a fixed current-carrying rod end of the vacuum valve, a polygonal movable conductor connected to a movable current-carrying rod end of the vacuum valve, an operation movable rod connected to the movable conductor in an axial direction and connected to an operation mechanism, a second main circuit conductor, through which the operation movable rod is movably inserted, and at least one extendable flexible conductor, which connects side surfaces of the movable conductor and the second main circuit conductor.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will now be described with reference to the accompanying drawings.

Figure 1:
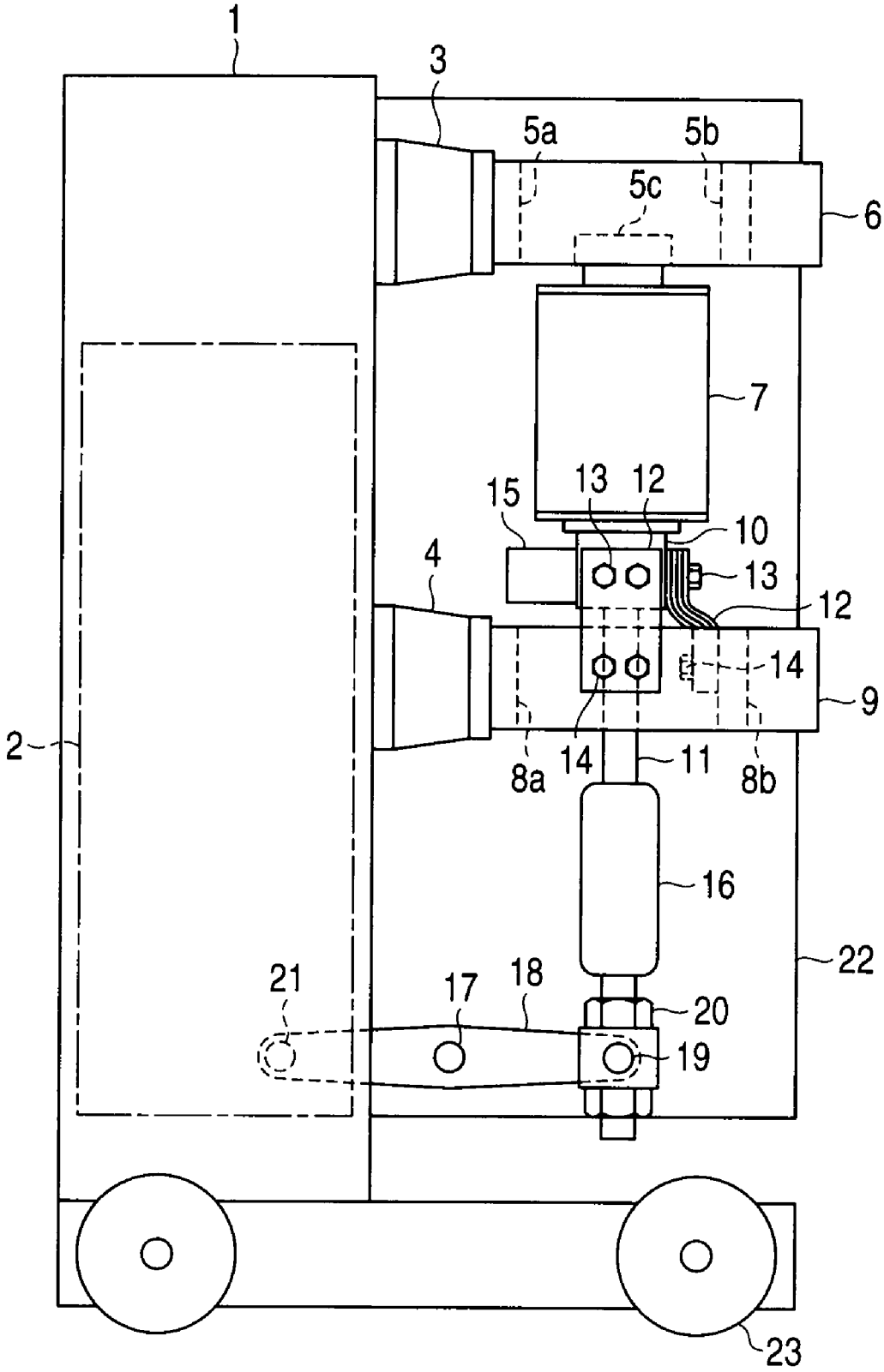
FIG. 1 is a side view showing a configuration of a vacuum circuit breaker according an embodiment of the present invention.
Figure 2:
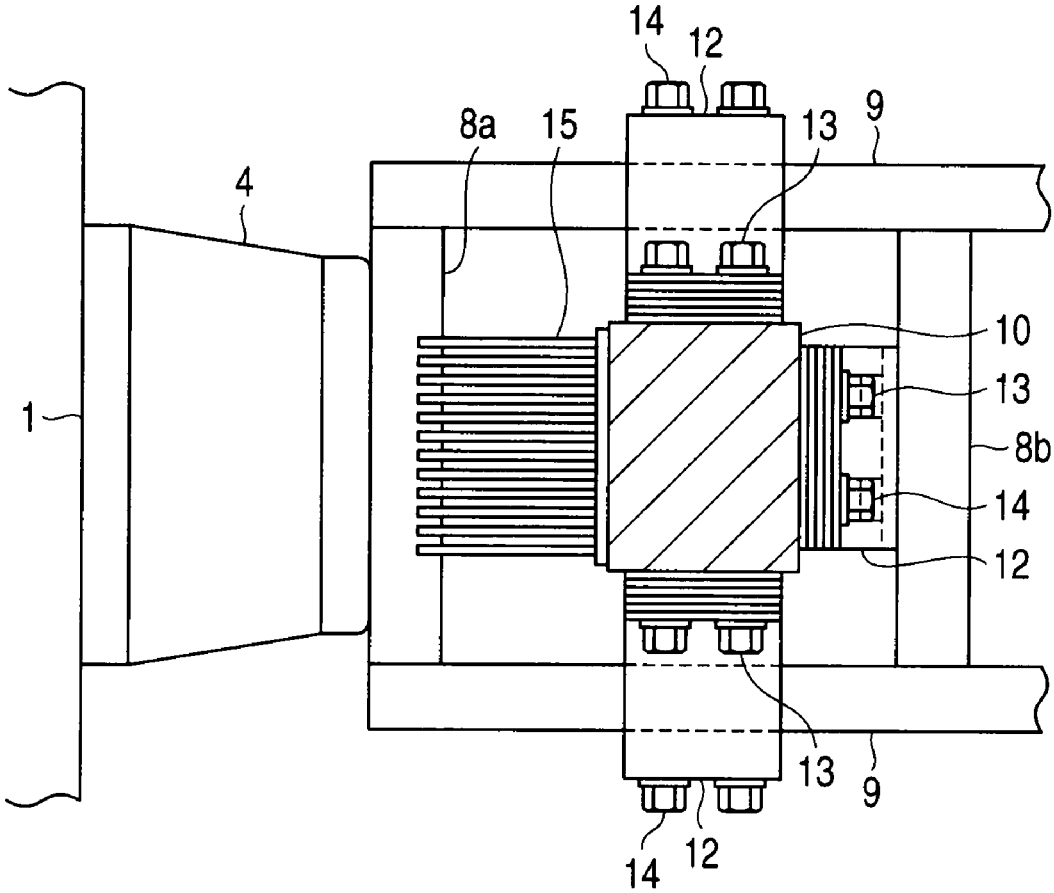
FIG. 2 is a cross-sectional view showing an upper part of a movable rod portion of a vacuum valve of the embodiment.

A vacuum circuit breaker according to one embodiment of the present invention will be described with reference to FIGS. 1 and 2. FIG. 1 is a side view showing a configuration of a vacuum circuit breaker according an embodiment of the present invention, and FIG. 2 is a cross-sectional view showing an upper part of a movable rod portion of a vacuum valve of the embodiment.

As shown in FIG. 1, a main body frame 1 of a vacuum circuit breaker contains an operation mechanism 2 which opens and closes a main circuit. An upper support insulator 3 and a lower support insulator 4 are arranged with a distance therebetween and fixed to a side surface of the main body frame 1.

An upper arm conductor 5*a* is fixed to the upper support insulator 3. Two upper main circuit conductors (first main circuit conductors) 6 are fixed to the upper arm conductor 5*a* so as to sandwich it at first ends thereof. An upper arm conductor 6*b* is provided at second ends of the upper main circuit conductors 6 to allow another electronic apparatus to connect thereto. An upper arm conductor 5*c* is fixed to an intermediate portion of the upper main circuit conductors 6. A fixed current-carrying rod end of a vacuum valve 7 is fixed to the upper arm conductor 5*c*, and has a pair of contacts, which are free to be connected/released to/from each other.

A lower arm conductor 8*a* is fixed to the lower support insulator 4. Two lower main circuit conductors (second main circuit conductors) 9 are fixed to the lower arm conductor 8*a* so as to sandwich it at first ends thereof. A lower arm conductor 8*b* is provided at second ends of the lower main circuit conductors 9 to allow another electronic apparatus to connect thereto.

A rectangular movable conductor 10 is connected to a movable side of the vacuum valve 7 along the axial direction by, for example, brazing, and further an operation movable rod 11 is connected thereto along the axial direction. Thus, an end of a movable current-carrying rod, which is round and rod-shaped, is exposed outside the vacuum valve 7. The movable conductor 10 is electrically connected to the movable current-carrying rod end, and the operation movable rod 11 is mechanically connected to the movable conductor 10. The operation movable rod 11 is movably inserted between plates in intermediate portions of the lower main circuit conductors 9.

As shown in FIG. 2, first ends of three extendable flexible conductors 12 are respectively fixed by bolts 13 to a back surface and side surfaces of the four surfaces of the movable conductor 10. Each of the flexible conductors is formed of a plurality of thin plates, which are laminated. A second end of the flexible conductor 12 on one of the side surfaces of the movable conductor 10 is fixed to one of the lower main circuit conductors 9 by bolts 14, and a second end of the flexible conductor 12 on the other of the side surfaces of the movable conductor 10 is fixed to the other of the lower main circuit conductors 9 by bolts 14. A second end of the flexile conductor 12 on the back surface of the movable conductor 10 is fixed to a side surface of the lower arm conductor 8*b* by a bolt 14. Further, a radiating fin 15 is fixed to a front surface of the movable conductor 10.

An insulating operation rod 16 extending along the axial direction is connected to the operation movable rod 11. One end of an operation lever 18, which rotates about a fixed pin 17, is connected to the insulating operation rod 16 via a movable pin 19. The end of the operation lever 18 is fixed by a double nut 20. The other end of the operation lever 18 is connected to the operation mechanism 2 via a movable pin 21. An insulating barrier 22 is provided between phases of the vacuum circuit breaker for insulation of main circuits, such as the vacuum valve 7, of the respective phases. Elements 23 are wheels 23 to move the vacuum circuit breaker.

In the above configuration, only the flexible conductor 12 is connected to the lower main circuit conductor 9 with screws on the movable side of the vacuum valve 7 without a plate-like coupling conductor, which is required in the conventional art. Thus, the number of parts is less as compared to the conventional art. The reduction in number of parts reduces the mass of the movable portion and can reduce the energy for operating the operation mechanism 2. The movable conductor 10 is connected to the movable current-carrying rod of the vacuum valve 7 in advance by brazing or the like during the process of manufacturing the vacuum valve 7. Therefore, the contact resistance between the vacuum valve 7 and the movable conductor 10 is very small, and it is unnecessary to count the movable conductor 10 as a part.

Further, since the movable conductor 10 is rectangular, a plurality of flexible conductors 12 can be connected to the respective side surfaces. Therefore, the increase in contact resistance due to screw connection, which is most liable to increase the temperature, can be suppressed. Further, since the radiation fin 15 is attached, the increase in temperature can be suppressed.

In the vacuum circuit breaker of this embodiment, the rectangular movable conductor 10 is connected to one end of the current-carrying rod of the vacuum valve 7 and the movable conductors 12 are connected to three of the four side surfaces of the movable conductor 10 and the radiation fin 15 is attached to the remaining one side surface thereof. Therefore, the number of parts in the movable side, which is most liable to increase the temperature, can be small. Further, since the electrical resistance is reduced and radiation effect is improved, the current capacity can be increased.

The present invention is not limited to the embodiment described above, but can be modified variously without departing from the sprit or scope of the invention. Although the movable conductor 10 of the embodiment is rectangular, it may be a polygonal body having three or more sides, so that flexible conductors 12 and a radiation fin 15 can be provided on the respective side surfaces. The number of flexible conductors 12 and radiation fins 15 can be determined to suit the current capacity of the vacuum circuit breaker. More specifically, at least one flexible conductor 12 can be connected to a side surface of the polygonal movable conductor 10. In terms of the arrangement of the flexible conductor 12 and the radiation fin 15, it is preferable that the movable conductor 10 be rectangular. The arrangement of the embodiment described above is particularly preferable to suppress the increase in temperature.

As has been detailed above, according to the present invention, a polygonal movable conductor is connected to the movable current-carrying rod end of the vacuum valve, and at least one movable conductor and a radiation fin are attached to the surfaces of the movable conductor. Therefore, the electrical resistance in the movable side, which is most liable to cause increase in temperature, can be less and the current capacity can be increased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A vacuum circuit breaker comprising:

a vacuum valve;

a first main circuit conductor fixed to a fixed current-carrying rod end of the vacuum valve;

a polygonal movable conductor connected to a movable current-carrying rod end of the vacuum valve;

an operation movable rod connected to the movable conductor in an axial direction and connected to an operation mechanism;

a second main circuit conductor, through which the operation movable rod is movably inserted; and at least one extendable flexible conductor, which connects side surfaces of the movable conductor and the second main circuit conductor, wherein:

the movable conductor has a rectangular body, the flexible conductors are connected to a back surface and side surfaces of the movable conductor, and a radiation fin is attached to a front side surface of the movable conductor.

* * * * *